United States Patent [19]

Miller et al.

[11] 4,130,157

[45] Dec. 19, 1978

[54] SILICON NITRIDE ($Si_3N_4$) LEACHABLE CERAMIC CORES

[75] Inventors: Donald G. Miller, Bethel Park; Frederick F. Lange, Murrysville, both of Pa.

[73] Assignee: Westinghouse Electric Corp., Pittsburgh, Pa.

[21] Appl. No.: 706,334

[22] Filed: Jul. 19, 1976

[51] Int. Cl.[2] ..... B22D 29/00; B22C 1/00

[52] U.S. Cl. ..... 164/132; 164/41; 164/138; 106/38.2; 106/38.9

[58] Field of Search ..... 164/23, 36, 41, 132, 164/138, 34; 106/38.2, 38.22, 38.27, 38.9

[56] References Cited

U.S. PATENT DOCUMENTS

| | | | |
|---|---|---|---|
| 3,011,233 | 12/1961 | Kirtchik | 164/132 X |
| 3,643,728 | 2/1972 | Hulse | 164/36 X |
| 3,698,467 | 10/1972 | Fassler et al. | 164/132 |
| 3,709,459 | 1/1973 | Bushrod | 164/138 X |
| 3,727,670 | 4/1973 | Bailey | 164/132 |

OTHER PUBLICATIONS

*The Condensed Chemical Dictionary,* Reinhold Pub. Corp., New York, 1963, pp. 1019–1020.

*Primary Examiner*—Francis S. Husar
*Assistant Examiner*—Gus T. Hampilos
*Attorney, Agent, or Firm*—R. T. Randig

[57] ABSTRACT

A method of producing cast articles having internal cavities is disclosed. The method is particularly suitable for casting gas turbine components from nickel base and cobalt base superalloys. The method comprises: forming a core to the desired cavity configuration, the core consisting essentially of densified silicon nitride; securing the core within a mold; casting the alloy within the mold and around the core; removing the solidified cast article from the mold; and leaching the silicon nitride core from the casting in molten sodium hydroxide.

7 Claims, No Drawings

SILICON NITRIDE ($SI_3N_4$) LEACHABLE CERAMIC CORES

BACKGROUND OF THE INVENTION

1. Field of the Invention

The invention relates generally to the field of investment casting and more particularly to a method of casting superalloys having core cavities therein. The method employs a novel ceramic core consisting essentially of densified silicon nitride which is readily leachable in molten sodium hydroxide.

2. Description of the Prior Art

Metal temperatures of gas turbine components are generally controlled by circulating cooling air through complex internal passages and cavities in the blades and vanes of the turbine. These turbine components are generally cast from cobalt base and nickel base superalloys by the shell investment molding process. Preformed ceramic cores are generally used within the shell mold to form the complex internal passages in these cast components.

In the investment casting process, pattern wax is injected into a die around a preformed ceramic core or cores to duplicate the metal part to be produced. The wax replica together with the sprew and attached gating are dipped into a silica, zircon or alumina slurry using colloidal silica, aqueous sodium silicate or ethyl silicate as the vehicle. Slurry dipped pieces are stucco coated with refractory grain by dusting, tumbling or immersion in a fluidized bed. In usual practice, a ⅛ inch to ¼ inch thick shell mold is eventually built up by repeated dipping, dusting and drying. After the core-wax pattern shell mold assembly is air dried, the wax is removed by flash firing. The mold with the ceramic core or cores secured within is then transferred to a vacuum casting furnace and preheated to about 1800° to 1950° F. The nickel or cobalt base superalloy is then cast into the shell mold at a temperature of about 2600° F. After solidification of the metal, the shell mold is removed usually by fracturing it. Castings are then sand or vapor blasted to remove any adhering shell mold material. The sprew and gating are cut from the useful portion of the casting and the casting is dipped in a leaching bath such as sodium hydroxide to remove the ceramic core material from the internal passages formed therein. The leaching operation normally takes place at 1000° to 1100° F. with up and down agitation for a period of about 2 to 6 hours. The leaching media must preferably remove the ceramic core quickly and completely without attacking the metal alloy casting.

Generally, most of the ceramic cores presently in use are formed of a blend of silica and zircon. Core shapes are slip cast using water or ethyl silicate or injection molded utilizing various resin systems and plasticizers suitable for the extrusion. The molded silica zircon cores are then fired to produce a densified core body. Other popular core materials presently in use are aluminum silicate and fused silica. Fused silica and products of the silicate systems of the type set forth above are leached in molten caustic or hydrofluoric acid.

Other attempts have been made to provide cores made from calcium oxide compositions which are leachable in water, see for example U.S. Pat. No. 3,576,653 and U.S. Pat. No. 3,643,728. These formulations are difficult to handle however because calcium oxide absorbs water readily in air to form calcium hydroxide a compound which tends to crumble easily.

Special handling techniques, therefore, must be employed with the calcium oxide compositions.

Another die casting core formed of sand, coated on its outer portion with a high melting point inorganic sealing salt, is disclosed in U.S. Pat. No. 3,501,320. This formulation is said to be readily leachable in hot water.

In the popular silicate system presently in use, core breakage due to poor strength contributes significantly to the rejection rate in finished castings. The strength of these currently used core materials cannot generally be increased without concurrently reducing solubility to levels where core removal is slow or even incomplete. Core density is therefore kept as low as practicable in order to increase the leach reactant surface area and also to reduce shrinkage of the core during final firing.

In addition to the density-strength problem of the silica materials, fused silica compositions are thermally unstable over 2000° F. Devitrification with the crystallization of the beta crystobalite occurs with volume expansion. Upon cooling from an overfired condition, the beta to alpha transition is accompanied by large volume changes which may fracture the core. Large concentrations of crystobalite increase the thermal expansion in the core to the point where, upon heating, incompatibility causes the core to push out through the shell mold. The presently-used silica core is at best a compromise material which can survive the casting process and be removed from a casting only with difficulty.

Casting defects directly associated with the core materials of the prior art include: inclusions left in the alloy wall from core particle pull out; entrapped core material after leaching due to locally insoluble masses within the core or poor access of leaching media; unfilled areas on the wall of the casting resulting from core shift, breakage or distortion at the time of pouring; shell mold rupture or cracking resulting from thermal expansion mismatch between shell and core; and porosity in the casting due to reaction of molten metal with the core material to produce gases or evolution of the trapped gases from cores upon impingement of molten metal.

SUMMARY OF THE INVENTION

Our invention solves many of the problems heretofore encountered with ceramic core materials by providing a method of casting the nickel base and cobalt base superalloys utilizing fused silicon nitride as the ceramic core material. The silicon nitride core may be formed by conventional hot pressing techniques utilizing silicon nitride powders or it may be formed using conventional reaction sintering techniques employing silicon metal powder as the starting material. In addition, densification aids such as magnesium oxide (MgO) are also preferably employed to improve the sinterability of the silicon nitride powder. After the shaped silicon nitride core is sintered, it is placed within the mold using conventional techniques and the superalloy is cast around the core to form the desired article such as a turbine blade or vane. The solidified casting is removed from the mold and the silicon carbide core is leached therefrom using molten sodium hydroxide (NaOH).

DETAILED DESCRIPTION OF THE PREFERRED EMBODIMENT

We have found that hot pressed or reaction sintered silicon nitride, a highly attack resistant ceramic material, is 100% soluble in molten sodium hydroxide at 600° C. Both the hot pressing method and the reaction sintering method of forming silicon nitride bodies are well known to those skilled in the art. In the reaction sintering method, silicon metal powder is employed as a starting material. The core is formed to the configuration of the internal passage desired. This shaping step may be accomplished by injecting molding a quantity of silicon powder with an organic resin binder mixed therewith under pressure. Polyvinyl alcohol is a preferred binder although others of course may be used. The molded core may then be heated for several hours at about 600° C., well below the sintering temperature of silicon powder, to remove the resin binder and provide an article which is essentially a green compact of silicon powder. The core is then reaction sintered in the absence of pressure in a nitrogen atmosphere to form the desired end product of silicon nitride. Core densities of between 60 to 87% of theoretical density are achieved by this reaction sintering technique.

Alternatively, silicon nitride powder may be employed as a starting material in forming the core when utilizing the hot pressing technique. Hot pressing ceramic materials is also well known to those skilled in the art. The hot pressing method yields cores of 99%+ of theoretical density which are of excellent strength. In working with the silicon nitride system, we have found it advantageous to also employ small amounts of a densification aid such as MgO which greatly improve the sinterability of the system. Amounts from ½% to 10% MgO may be employed in the powder mix.

After the core has been formed either by reaction sintering or by hot pressing, the densified core is secured in the shell mold and the alloy is cast within the mold and around the core in the conventional manner. The casting is then allowed to cool and the solidified casting is removed usually by breaking the shell mold. The silicon nitride core is then removed from the casting by leaching in molten sodium hydroxide.

By way of example a piece of hot pressed silicon nitride ⅛ inch by ½ inch by ½ inch was removed completely in 28 minutes from a piece of cast nickel by leaching in molten sodium hydroxide at a temperature of 600° C. This excellent solubility, coupled with the desirable physical and thermal properties of silicon nitride, make a material ideal for core manufacture. It is also possible to produce complex close tolerant shapes by injection molding and reaction sintering. Silicon nitride exhibits good strength beyond 2500° F. and does not undergo phase transitions after final firing. It is also soluble in sodium hydroxide, possesses a high elastic modulus and displays thermal expansion compatible with existing shell mold compositions. The strength of the core can be controlled by its density in order to eliminate tearing in its finished casting. In addition, silicon nitride is relatively inert in contact with most molten metals.

Properties of silicon nitride pertinent to core material applications are listed below:

| | |
|---|---|
| Density | 1.59 – 3.18 gm/cc |
| Modulus of rupture, RT | 20,000 psi – 100,000 psi (function of density) |
| Modulus of elasticity | 28–40 × $10^6$ psi (density sensitive) |
| Thermal expansion | 1.38 – 1.53 inch/inch/° F RT - 1800° F |
| Thermal conductivity | 1.0 – 3.5 Btu/hr ft ° F |
| Specific Heat | 0.25 – 0.27 Btu/lb ° F |

We claim:

1. A method of producing shaped articles from nickel or cobalt base superalloys having at least one internal passage therein, the method comprising the steps of:
   (a) providing a core to conform with the shape of the internal passage, said core consisting substantially of sintered silicon nitride ($Si_3N_4$) having a density between about 60% and 99%+ of theoretical density of $Si_3N_4$;
   (b) securing the core within a mold;
   (c) casting the superalloy within the mold and around the core;
   (d) removing the solidified, superalloy casting from the mold; and
   (e) leaching the core from the internal passage of the cast article in molten sodium hydroxide (NaOH).

2. The method of claim 1 wherein the core consists essentially of silicon nitride and up to about 10% by weight magnesium oxide (MgO).

3. The method of claim 1 wherein the sodium hydroxide is at a temperature of about 600° C.

4. The method of claim 1 wherein the silicon nitride core is formed by hot pressing silicon nitride powder.

5. The method of claim 4 wherein the density of the sintered core is between 99% and 100% of theoretical density of $Si_3N_4$.

6. The method of claim 1 wherein the silicon nitride core is formed by reaction sintering silicon powder in atmosphere containing nitrogen.

7. The method of claim 6 wherein the density of the sintered core is between about 60% and 90% of theoretical density of $Si_3N_4$.

* * * * *